United States Patent [19]

Waldburger

[11] 4,328,254

[45] May 4, 1982

[54] PURVEYING COOKED FOOD

[75] Inventor: Peter Waldburger, Toronto, Canada

[73] Assignee: The Continental Group of Canada Ltd., Toronto, Canada

[21] Appl. No.: 195,657

[22] Filed: Oct. 9, 1980

[30] Foreign Application Priority Data

Jul. 23, 1980 [CA] Canada ..... 3567999

[51] Int. Cl.[3] ..... B65D 21/02; A47G 19/00; A23L 1/00

[52] U.S. Cl. ..... 426/393; 206/558; 220/23.4; 220/23.83; 426/87; 426/106; 426/114; 426/115; 426/120; 426/383; 426/520; 426/524

[58] Field of Search ..... 426/113, 114, 119, 120, 426/124, 115, 393, 106, 87, 383, 520, 524; 220/23.4, 23.83, 23.86, 23.8; 206/558

[56] References Cited

U.S. PATENT DOCUMENTS

| | | | |
|---|---|---|---|
| 2,501,400 | 3/1950 | Marshall | 426/234 |
| 2,674,536 | 4/1954 | Fisher | 426/114 |
| 2,768,086 | 10/1956 | Bliley | 426/393 |
| 3,107,027 | 10/1963 | Sheng-Chiao Hong | 220/23.8 |
| 3,240,610 | 3/1966 | Cease | 426/113 |
| 3,244,537 | 4/1966 | Cease | 426/393 |
| 3,610,458 | 10/1971 | Nissley | 220/23.83 |
| 3,615,713 | 10/1971 | Stevenson | 426/114 |
| 3,642,499 | 2/1972 | Castell | 426/115 |
| 3,924,013 | 12/1975 | Kane | 426/234 |
| 3,997,677 | 12/1976 | Hirsch et al. | 426/113 |
| 4,081,646 | 3/1978 | Goltsos | 426/107 |
| 4,147,836 | 4/1979 | Middleton et al. | 426/113 |

FOREIGN PATENT DOCUMENTS

| | | | |
|---|---|---|---|
| 460545 | 10/1949 | Canada | 426/114 |
| 859948 | 1/1961 | United Kingdom | 426/414 |
| 1172377 | 11/1969 | United Kingdom | 426/414 |

*Primary Examiner*—Steven L. Weinstein
*Attorney, Agent, or Firm*—Alan Swabey; Robert Mitchell; Guy Houle

[57] ABSTRACT

A method of purveying food in which a variety of foods are cooked and frozen in disposable containers of ovenable sheet material each having a mouth surrounded by an outstanding lip and preferably a removable cover. At the time of serving, a plurality of the containers of frozen food are selected, to make up a meal, and a serving assembly provided by placing them in inverted position on an ovenable serving plate having a retaining rim, with the lips of adjacent containers overlapping each other or abutting the rim and to form a base that seats on the plate surface. The assembly is then heated to eating temperature and placed before the diner and the containers removed to display the foods as a normal serving. An aspect of the invention is the ovenable assembly of filled containers inverted on a serving plate having a retaining rim.

9 Claims, 5 Drawing Figures

FIG. 1.
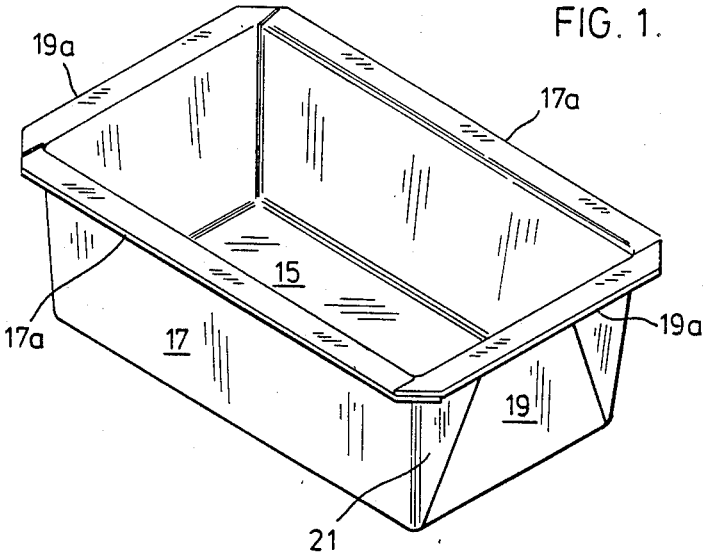
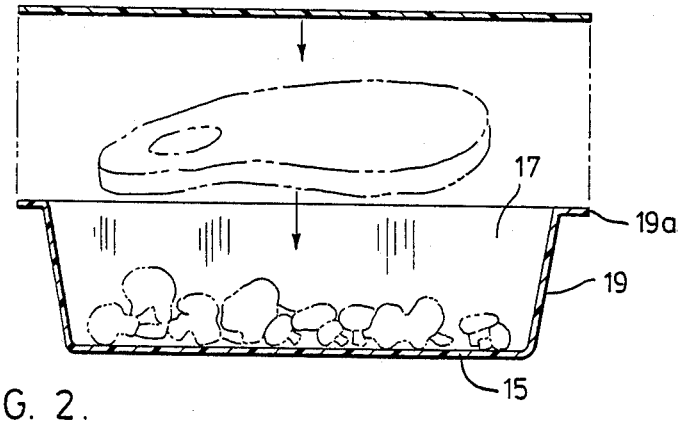
FIG. 2.

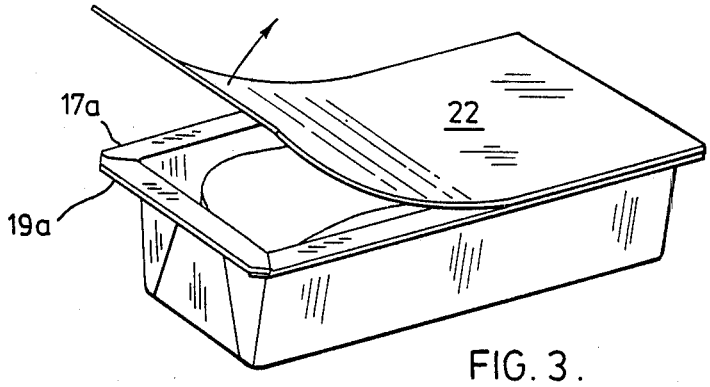
FIG. 3.
FIG. 5.
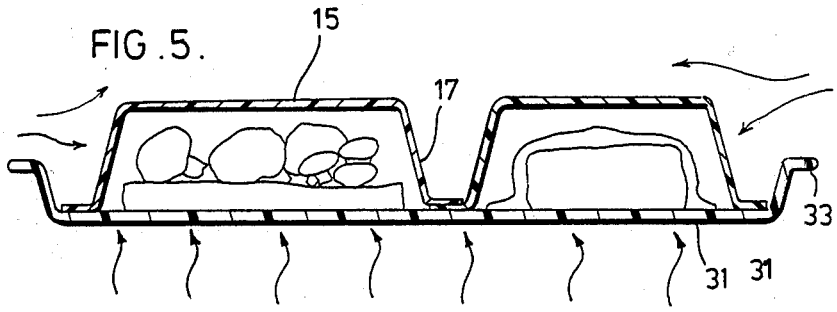
FIG. 4.
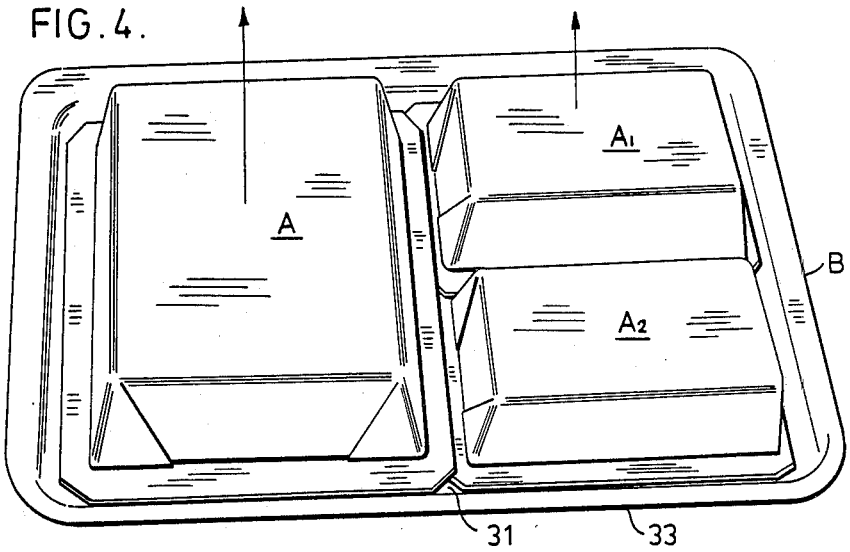

PURVEYING COOKED FOOD

BACKGROUND OF THE INVENTION

1. Field of the Invention

This invention relates to a culinary art.

More specifically, it relates to a method, specially useful in hospitals and other institutions, for the efficient and aesthetic purveying of standardized meals made up of several different hot dishes, for example, an entree and assorted vegetables. Accordingly, the invention will be described in this context, by way of example.

2. Description of Prior Art

At the present time, there are the following main ways in which food is served in hospitals.

In one of these procedures, batches of precooked food are placed in receptacles on warming trolleys in a central kitchen, and moved on the trolleys, to the wards, where the food is kept warm and portioned out on the individual patient's dishes.

Another procedure is to dish out the hot food, in the main kitchen or sub-kitchen, into an insulated compartmented tray for each patient and to place an insulated cover on the tray. The tray is transported to the ward and the cover removed, when the food is put before the patient.

According to another procedure, the food is cooked and chilled to a temperature of say 40° to 50° F. and placed in the cold state, on serving plates, in a central kitchen. The serving plates are then covered with metal covers to prevent dehydration. The plate with the cold food on it is put into a warming oven on the ward level, the cover removed and the food served on the plate.

There is also a procedure in which the food, contained in plastic containers is heated by microwave. The problem here is that the different foods do not cook uniformly and plastic containers do not permit of cooking by other means.

There is also a procedure in which there are used ovenable plastic-coated paperboard containers in which the food is precooked and frozen. The food is warmed prior to serving and served in the container.

All these procedures have their disadvantages, and it is an aim of the present invention to provide a practical improved procedure. More specifically, it is an aim of the invention to combine an economical and efficient manner of cooking, freezing, heating and transporting a hygienic, palatable food with an aesthetic manner of serving it.

SUMMARY OF THE INVENTION

According to the present invention, a special type of container is employed which serves to hold the food, during freezing and transporting, and which serves as a removable cover for the food during reheating. A preferred container is made from ovenable plastic coated paperboard and has a receptacle part including a floor and an upwardly and outwardly extending wall having a mouth surrounded by a rectangular lip. Different sized containers are used for different foods. For example, a large container might be used for a main entree, while smaller companion containers contain accompanying vegetables. Broadly, in accordance with the invention, the food is cooked, then packed and frozen in the containers at a first station, usually a central kitchen remote from the dining area. It is thus possible to cook and freeze one kind of food one day and another another day, for economy of food and labour. The containers with the frozen food are immediately placed in storage under refrigeration. This can be at a central storage station or at substations, where the containers are ready for selection and use at any time.

As required, different types of food are requisitioned from storage by the dietitian. Assemblies are then put together, each of several containers of the type described containing respectively different cooked and frozen foods by selecting containers of a size and shape so that when inverted and the lips of adjoining containers overlap, are capable of forming an array of the inverted containers, having a regular rectangular outline defined by the edges of the container lips. An ovenable plate is selected to receive each array of containers, the plate having a flat base surrounded by an upstanding rim defining a receiving area of a size to be substantially occupied by the array of containers with their lips substantially flush with the rim.

An assembly of the plate and containers is then formed by removing the covers of the selected containers and placing them upside down on the plate, to form an array, with the lips of adjoining containers overlapping and, the outside lips of containers substantially abutting the rim of the plate. The array of containers is thus positioned, in the assembly, by contact of their lips with the walls of adjoining containers and with the rim of the plate. A seal is formed between the lips of the containers and the plate surface or between the rims of respective containers so that the escape of food, which becomes fluid on heating, is prevented. The assembly is then heated to bring the food to at least eating temperature.

Heating is preferably effected in a forced air convection oven, typically equipped with fans which create a strong draught of air over the containers. Once the food has been unfrozen and released from the wall of the containers, one would normally expect the light containers to be blown away by the draught. It has been found, however, that the array of containers in the plate with its high rim prevents this from taking place.

The assembly is then transported to the dining area and placed before the patient, and the containers lifted off the plate to leave respective islands of food exposed for eating.

The method involves the use in serving each meal of an assembly made up as follows. It includes a plate of ovenable material having a flat receiving base surrounded by an upstanding rim. An array, on the plate, of several containers, each having a receptacle part surrounded by an outstanding peripheral lip, is formed by specially placing the receptacles, containing the cooked frozen food, upside down on the plate to provide open-bottomed closed-topped enclosures. The receptacles are of a size and shape relative to each other and to the dish and are arranged so that their lips substantially abut the rim of the plate or overlap the lips of other containers. The lips also contact with the surface of the plate to prevent escape of fluid food and minimize scorching during cooking.

Among the advantages of the present development are the following. The nutritional elements, for example, vitamins are preserved and by freezing immediately after cooking, there is insufficient time for any form of contamination, for example, by bacteria growth. The system lends itself to proper proportioning of foods and the provision of special diets and the various containers can be readily labelled or color coded as to contents and amount. From an economic point of view, cooking can be performed in a central kitchen which can serve a number of different hospitals or other institutions. Economy in cooking can be effected by cooking one or two foods at one time and other foods at another. The ability to classify and store the containers of food makes it possible to have a permanent supply of food ready at a moments notice, e.g. for emergencies. The element of variety and choice is available since desired foods may merely have to be requisitioned from storge when required and reheated. Waste is cut down since food not used is left in storage. Labour is saved in the elimination of dishwashing since no intermediate pots or pans are used and the empty containers are sent to the garbage when they are removed from the plate and only the plates have to be washed. The containers are of standard size regardless of the exact portion of food, as distinct from the usual type of food container which is governed by the size of the portions. The containers function as an attractive serving unit for single service meals from time of removal from storage, through reheating, transporting to the user and service of the meal. The inverted containers, in effect, form miniature steam cabinets that ensure good release of frozen food from the container, and retain the heat of the food at desirable eating temperatures for 20 to 30 minutes. The containers can be decorated with any desired motif for pleasing appearance and/or identification while, at the same time, serving as protective covers to retain heat and moisture until the food is actually served. They are, of course, printed upside down as compared to a conventional container.

The inter-relationship between the respective parts of the food service unit, i.e. the serving plate, its upstanding rim, and lips on the food containers provides a complete and practical assembly that will fulfill differing requirements of storage, reheating, protection in transit, and attractive food service. The food is served in a homelike manner on a single plate after the inverted containers are removed.

BRIEF DESCRIPTION OF THE DRAWINGS

The invention has generally been described, and will now be referred to more specifically, by reference to the accompanying drawings illustrating preferred embodiments and in which:

FIG. 1 is a perspective view showing a type of portion container employed;

FIG. 2 is a diagrammatic side elevation showing diagrammatically the placement of food in the lid of the container at the cooking station, with food being dished out in the container in upside down relationship to its ultimate position;

FIG. 3 is a perspective view showing a container with frozen food and in the process of being removed in readiness for placement of the container on the plate in inverted position;

FIG. 4 is a perspective view showing a serving unit assembly made up of a plate and an array of containers;

FIG. 5 is a cross-section as along the line 5—5 of FIG. 4 showing the relationship, in the assembly, of the plate, containers and food.

DESCRIPTION OF THE PREFERRED EMBODIMENTS

Referring more specifically to the drawings, a preferred form of container A is made up of a single blank of ovenable paperboard coated on one surface with a thin coating of polyester resin. This material is well known in the art. Structurally, the container has a rectangular floor 15 from the margins of which there extend upwardly sidewalls 17 and endwalls 19 which slope outwards from the floor 15 at a small angle to the perpendicular. The surplus board overlaps in folds 21 at the corners. The walls terminate remote from the floor to a mouth at which the sidewalls 17 and endwalls 19 have lips 17*a* and 19*a* respectively which extend outwards substantially parallel to the floor.

In accordance with the invention, where appropriate, food is placed into the containers in an inverted position so that, when the container is inverted, the food is right side up, for reasons which become evident. For example, in the case of a steak with gravy, the gravy would be placed in the container first, next to the floor, with the steak on top of it.

The container is then provided with a lid 22 which is juxtaposed resin coating to resin coating and heat-sealed to the lips 17*a* and 19*a* respectively, so that the food is sealed within the container. The lid 22 may or may not be of the same material as the body of the container. Since the lid is removed prior to reheating, it is not subjected to high temperature so plastic sheet material can be used.

Generally containers of different sizes are filled with a variety of different freshly cooked foods and immediately subjected to freezing temperatures so that the food is frozen. This is usually done at a central kitchen.

The system lends itself to great flexibility in that different foods may be cooked at different times and a supply of various foods provided, frozen and stored in refrigerators. Where forced air convection heating is used, blowing hot air over the containers, the rim 33 serves as a protective shield against any up-draught blowing the containers off the plate.

Then, in accordance with the invention, a number of assemblies are put together for reheating and serving the food. FIG. 4 illustrates one such assembly.

This assembly is made up of a plate B, in this case of porcelain. The plate is made up of a generally rectangular undivided floor or base surface 31 surrounded by an upstanding rim 33 which slopes outwards slightly from the perpendicular to the floor 31.

The plate carries, inverted, a large container A, as previously described, containing an entree and two smaller containers $A_1$ and $A_2$ containing respective vegetables. The food has been precooked and frozen as described above and the lids 22 removed from the respective containers and, where appropriate, the surface of the food, which was adjacent to the lid 22, is now lowermost and juxtaposed to the floor 31 of the plate. The containers A, $A_1$ and $A_2$ are arranged so that the outside lips 19*a* of the container A and the outside lips of the containers $A_1$ and $A_2$ are substantially flat against the floor 31 with their edges substantially abutting the rim 33. The inside edges of the containers $A_1$ and $A_2$ overlap the inside edge of the container A.

In the assembly of the containers and the plate, the containers form an array which is held in position by contact of the containers with each other and with the rim 33 of the plate.

The rims of the containers are pressed against the surface of the floor 31 by the weight of the food so that the lips of the containers virtually form a seal with the surface of the floor 31.

A number of such assemblies of containers and plates are put into a heating apparatus and heated, the containers now serving as a cover or hood preventing dehydration of the food and protecting it until served. Then, the individually heated assembly is removed from the heating apparatus, placed before a patient, and the covers removed to leave the heated food on the plate in separated portions, substantially as it would normally be served in a hotel (English style).

PREFERRED PLATE

The plate may be of any ovenable material and is preferably of porcelain. The material should be suitable for reheating in micro-wave ovens as well as conventional ovens. The size of the plate will be selected as described above to suit an array of containers. It is preferable that the rim be at an angle of close to the perpendicular as feasible. For manufacturing purposes, however, there is a compromise and, generally speaking, the angle of the rim of the porcelain plate will preferably be from 12° to 15° from the perpendicular. It is desirable that there be some angle from the perpendicular so as to assure nestability of the plates. The preferred minimum height of the rim of the plate is about 25 mm. with a recommended range to form a dish from about 16 mm. to about 25 mm. deep. The upstanding rim holds the food serving unit together during reheating. The preferred plate illustrates a rectangular receiving area within the retaining rim. However, the invention is not necessarily limited to this particular shape.

CONDITIONS

Freezing may be by any convenient method and a preferred freezing temperature is about −180° C. to about −190° C.

Heating may be by any conventional method. The present method lends itself to the use of readily available heating like hot air convection heating, usually to a temperature of between 325° F. to 400° F.

PREFERRED CONTAINER

A preferred container, in accordance with the invention, is generally of the construction described above. It is made of an ovenable sheet made of paperboard covered with a thin coating of polyester resin. The resin-coated surface is at the inside of the container in contact with the food. The container could be of the type known as "Traytite" which is now used in a food packaging method called "The Sprinter System". The sizes of the containers will vary depending on the food to be contained. For example, the container A, as shown in the above example, is about 130 mm. in length by 110 mm. in width. The containers $A_1$ and $A_2$ are 110 mm. in length by 68 mm. in width. The width of the lip may vary. In the specific examples shown, the lip is about 8 mm. The thickness of the material may also vary with a preferred thickness from about 350 to 450 micrometers. For the sake of economy, it is desirable to use as thin a material as possible while still retaining sufficient rigidity for its purposes, particularly for handling. The lid may be of the same material and is preferably heat-sealed to the container resin to resin. In this way, the lid can be removed by peeling it off since the resin to resin bond is greater than the resin to paper bond and both layers of polyester will be stripped from the rim. The lid need not be of the same material, however, it could be a plastic film lid because it is removed in any event before cooking.

ADVANTAGES

In terms of the procedure, according to the invention, there are the following advantages:

1. Bulk food preparation:

The method of the invention combines the efficiency of a central commissary in preparing large volumes of food with the aesthetics of unit serving. Previous emphasis has been on efficiency of preparation with unit serving being secondary. The present invention combines both. The single serving container forms a low cost storage unit which is adaptable to high speed packaging methods. Fast freezing may be performed before or after a lid is placed on the container.

2. Bulk food storage:

The invention is readily adapted to long term cold storage. Freezing single service quantities insures maximum flexibility in making up individual special diet menus. Earlier precooking and freezing techniques have emphasized multiple serving units for storage.

3. Meal preparation:

Assembly of the selected food containers with the serving plate will usually take place in a central location. Preheating may take place in a central location or in sub-kitchens adjacent to the dining area. The applicant has found that contemplated difficulties in preheating are overcome by the present method, in that the light inverted containers (now serving as covers) do not blow off the special plate in hot air convection ovens, burning of food between the several food masses does not take place and semi-liquid foods can be prepared according to the invention.

I claim:

1. A method of purveying cooked food, comprising, selecting a plurality of disposable ovenable containers of assorted sizes and made of light weight ovenable material each having a receptacle part including a floor and a surrounding upstanding wall defining a mouth surrounded by an outstanding lip, filling a number of containers with individual portions of partially cooked food of a number of different kinds, affixing removable covers to the containers, and subjecting the filled containers to freezing, selecting several of said containers containing respective serving portions of different frozen foods to provide a serving and of a complementary size and shape so that when several containers are inverted on a surface and the lips of adjoining containers overlapped, an array of the inserted containers is formed having a margin defined by the edges of the container lips, selecting an array-matching ovenable plate having an undivided flat base surface merging into an upstanding retaining rim defining a receiving area of a size to be substantially completely occupied by the array of containers with the container lips forming the peripheral margin of the array substantially abutting the rim, forming a number of serving assemblies in which each is formed by removing the covers from several containers containing serving portions of different frozen foods and placing them upside down in an array on the plate surface, with lips of adjoining containers overlapping and the outside lips of containers substantially abutting the rim of the plate, whereby the containers are aligned and held in position in the array solely by overlapping contact of their lips with the walls of adjoining containers and with the rim of the plate and seating contact is effected between the rims of the containers and the plate surface and wall or the rims of other containers to limit the seepage and burning of food after heating, heating the serving assembly to bring the food, at least, to eating temperature, removing the containers to leave the respective foods exposed in several separate portions ready for eating.

2. A method, as defined in claim 1, in which the filled containers are subjected to freezing immediately after cooking.

3. A method, as defined in claim 1, in which the filled containers are stored between freezing and putting together the serving assembly.

4. A method, as defined in claim 1, in which at least some of the foods are placed in the containers with the upper side of the said some foods adjacent the floor so that when the container is inverted in the array the food is right side up.

5. A method, as defined in claim 1, 2 or 3, in which the base of the plate is substantially rectangular.

6. A method as defined in claim 1, 2 or 3, in which the outside of the containers are provided with indicia which are right side up when the containers are inverted.

7. An ovenable food serving unit, comprising, a plate of ovenable material having an undivided flat base surface surrounded by an upstanding rim, an array of several inverted containers each having a floor and an upstanding wall defining a mouth surrounded by an outstanding lip each providing an open-bottom closed-top enclosure each containing a serving portion of a different cooked and frozen food ready for heating, the containers being of a size relative to the plate and so arranged that their lips overlap lips of adjoining containers and form a peripheral margin seated on the plate surface and substantially abutting the rim of the plate and the lips contact the base to limit escape of food from the containers between the plate surface and lips to reduce burning when the unit is heated prior to serving.

8. An ovenable food serving unit, as defined in claim 7, in which the containers are rectangular and the plate has a rectangular base.

9. An ovenable serving unit, as defined in claim 7 or 8, in which the outside of the inverted containers are provided with indicia which are right side up when the containers are inverted.

* * * * *